US008979045B2

(12) United States Patent
Petrakis

(10) Patent No.: US 8,979,045 B2
(45) Date of Patent: Mar. 17, 2015

(54) RAILING EXTENSION DEVICE AND METHOD THEREFORE

(75) Inventor: John Christopher Petrakis, Ashburn, VA (US)

(73) Assignee: RLP Management Holdings, LLC, Franklin Lakes, NJ (US)

( * ) Notice: Subject to any disclaimer, the term of this patent is extended or adjusted under 35 U.S.C. 154(b) by 30 days.

(21) Appl. No.: 13/573,417

(22) Filed: Sep. 14, 2012

(65) Prior Publication Data

US 2013/0062481 A1 Mar. 14, 2013

Related U.S. Application Data

(60) Provisional application No. 61/573,145, filed on Sep. 14, 2011.

(51) Int. Cl.
*A47B 96/06* (2006.01)
*A47B 83/04* (2006.01)
*A47B 37/04* (2006.01)

(52) U.S. Cl.
CPC ..... *A47B 83/04* (2013.01); *A47B 37/04* (2013.01)
USPC ..... 248/205.1; 248/250; 248/240.2

(58) Field of Classification Search
USPC ..... 211/86.01, 87.01, 85.16, 88.03, 100, 211/101, 105.2, 42; 248/208, 240.2, 250, 248/236, 166, 251, 188, 419, 163.1, 370, 248/371, 140, 139, 125.8, 125.7, 473, 479, 248/469, 475.1, 205.1
See application file for complete search history.

(56) References Cited

U.S. PATENT DOCUMENTS

| | | | | | |
|---|---|---|---|---|---|
| 596,427 | A | * | 12/1897 | Richey | 182/106 |
| 1,531,159 | A | * | 3/1925 | Timmons | 248/236 |
| 1,733,485 | A | * | 10/1929 | Desrosiers | 211/94.03 |
| 2,889,764 | A | * | 6/1959 | McGrath et al. | 454/204 |
| 2,935,284 | A | * | 5/1960 | Reeves | 248/208 |
| 3,390,477 | A | * | 7/1968 | Galbraith | 42/94 |
| 3,559,941 | A | | 2/1971 | Holzman | |
| 4,848,610 | A | * | 7/1989 | Lai | 211/90.01 |
| 4,996,977 | A | * | 3/1991 | Tiedeken | 128/878 |
| 5,033,448 | A | * | 7/1991 | Sandweg | 126/25 R |
| 5,042,767 | A | * | 8/1991 | Yunker et al. | 248/201 |
| RE33,842 | E | * | 3/1992 | Ebentheuer | 248/97 |
| 5,282,595 | A | | 2/1994 | Conforti | |
| 5,755,411 | A | * | 5/1998 | Strong et al. | 248/118 |
| 6,263,867 | B1 | * | 7/2001 | Skelton | 126/37 B |
| 6,398,174 | B1 | * | 6/2002 | Emalfarb | 248/214 |
| 6,829,856 | B1 | * | 12/2004 | Moorman | 42/94 |
| 8,091,844 | B1 | * | 1/2012 | Bragg | 248/208 |

* cited by examiner

*Primary Examiner* — Kimberly Wood
(74) *Attorney, Agent, or Firm* — Rosenberg, Klein & Lee

(57) ABSTRACT

A railing mounting system for use on decks, balconies, fences or patios to provide additional surface space. In addition, the frame can be used to contain plantings, herb gardens, coolers, grills or other outdoor items. The mounting system is quickly and easily installed for use and just as easily removed and stored for subsequent use.

32 Claims, 17 Drawing Sheets

RAILING EXTENSION DEVICE AND METHOD THEREFORE

This application claims priority to U.S. provisional patent application 61/573,145 filed Sep. 14, 2011.

BACKGROUND

1. Technical Field

The present disclosure relates generally to a railing extension device for supporting various articles, and more specifically to a device that mounts to a railing and can support various items, including but not limited to a beverage cooler, trash can, a cooler, an electric grill, a glass surface for containing serving dishes and glasses, plants and/or an herb garden.

2. Description of Related Art

Decks, balconies and patios are prevalent in homes and restaurants and often contain a railing system of sorts to assist in providing a safety measure and barrier for occupants as decks, balconies and patios are often above ground level and/or may be near hazards such as water. Most decks, balconies and patios contain tables and chairs in order to provide places for people to eat and put their beverage glasses. The addition of tables and chairs often limits the amount of space available for people to stand and/or walk around on. Due to this, occupants often place plates and glasses on railings. These can easily be knocked off or slide off as the surface of the railing is not even due to warping or in the case of balconies the railing may only be one inch wide and therefore not useable for holding items.

To meet the problem of providing additional surface space for decks and patios, a frame and strap system has been developed which can quickly attach to any shape or size railing and may extend outward away from and/or inward on the deck, balcony or patio. The frame can be made of various durable materials, including but not limited to wood (including teak), aluminum, wrought iron, stainless steel, titanium, or a polymer/plastic material. The device has a rectangular frame shape, but could be square, circular, triangular or any polygonal shape if desired. In addition, the device can have one or more points of contact between the railing and the proximal portion of the frame for attachment of the device. One benefit of the device is its ability to adjust and attach to various shaped railings and various sized railings. The device also contains another member which is an additional point of contact from the frame to the floor/base of the deck, balcony or patio. This member is angled from the most external/distal portion of the frame to the base/floor. This member can be telescoping and can be attached to the frame via a hinge in order to allow for it to fold up and minimize space of the device when not in use. This member or leg could also occur on both sides of the device, with the second member/leg contacting the bottom horizontal brace of the railing or balcony.

Therefore, a need exists for a lightweight device that can quickly, easily and releasably attach to a railing, fence or the like, to provide additional surface area and/or additional display area for occupants to place various items including but not limited to food items or glasses.

SUMMARY

The present disclosure is directed to a railing extension device which provides a support frame that releasably attaches to a railing. The device can quickly and easily be attached to a railing or fence and then when it is no longer in use it can just as quickly and easily be removed and stored. The preferred embodiment of the device contains two brackets that mount to the proximal portion of the support frame (hereinafter frame). These brackets are permanently attached to the frame and contain an L shaped protrusion which accommodates a strap or cable member. The L shaped bracket could be replaced with various other well known means for holding the strap or cable in place and work just as efficiently. The strap or cable can be made from a variety of materials, including but not limited to nylon, rubber (synthetic or natural) or stainless steel. The strap member continues through a cinching buckle and can be tightened accordingly to maintain the position of the frame. The cinching buckle could also be replaced with other well known means for holding tension on a cable or strap and work just as well. Other types of tightening mechanisms can be used to tighten and secure the strap to the desired tension, including but not limited to a wench type mechanism, a rack and pinion type mechanism, or a spring loaded clamp mechanism. The strap from the buckle is attached at its other end to a U-shaped bracket. The U shaped bracket is moveable and can be of various lengths, widths and sizes and resides sandwiched between the frame and the railing. This allows the weight of whatever is put on top of the frame to further anchor the device to the railing. The U shaped bracket is uniquely locked in place by the use of a detent pin that is inserted through a slot in the side of the U shaped bracket and traverses across the entire width of the U shaped bracket and out a slot on the opposite side of the U shaped bracket. The pin resides in the slots and keeps the U shaped bracket locked in place. Lastly, the distal portion of the frame has a telescoping member or leg that is pivotally attached to the frame. Once extended, the leg contacts the surface of the deck, balcony or patio to provide additional support for the frame.

In another embodiment the device could contain drop in compartments for various items, including but not limited to a cutting board and utensils. It is also contemplated that the device could be adapted for marine applications as well as tailgating applications or with fences that have a horizontal cross member.

BRIEF DESCRIPTION OF THE DRAWINGS

The above and other aspects and features of the present disclosure will become more apparent in light of the following detailed description when taken in conjunction with the accompanying drawings in which.

DETAILED DESCRIPTION OF THE EMBODIMENTS

Figure 1:
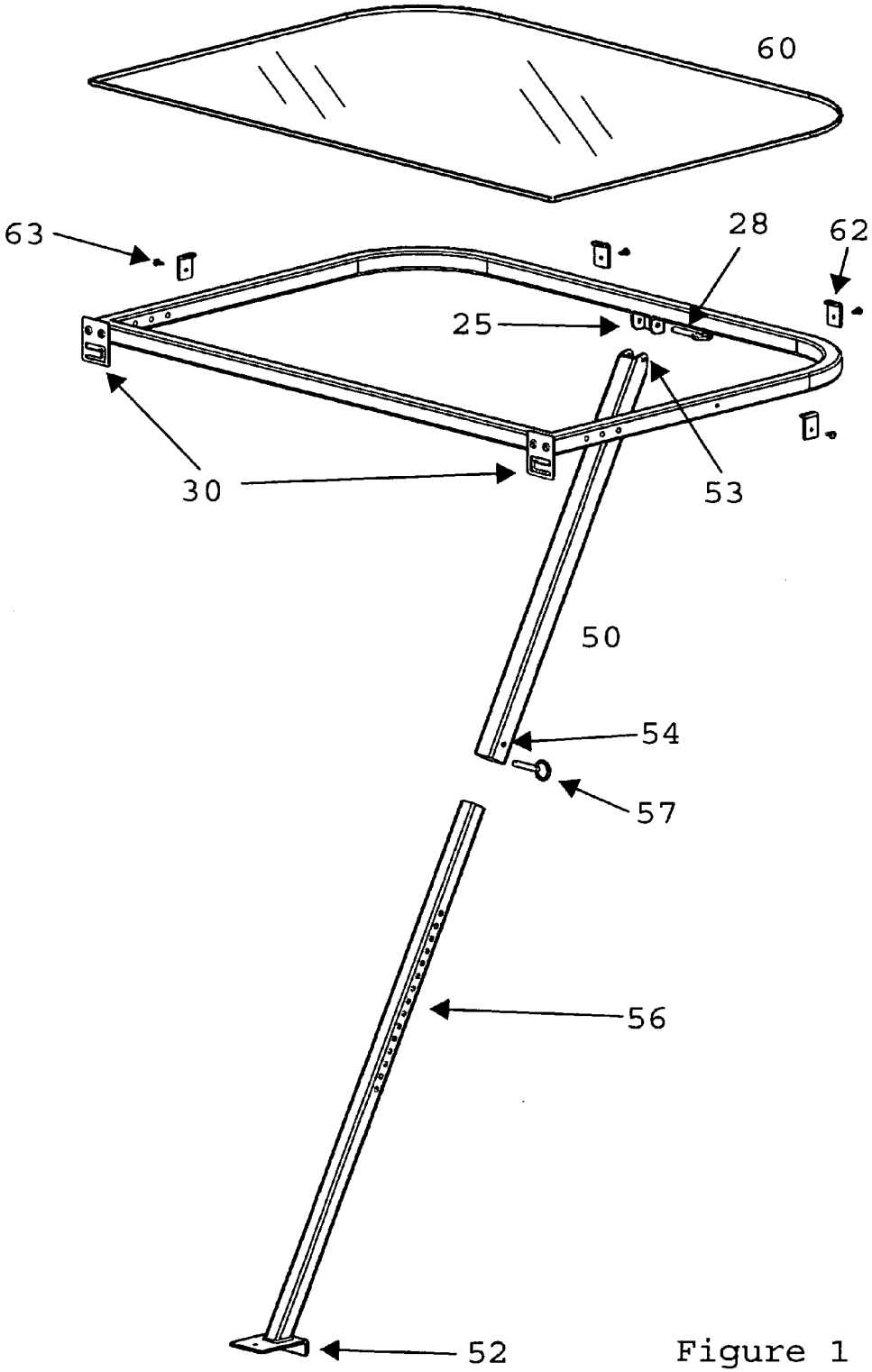
FIG. 1 is an exploded assembly view of the Deckmate device

Particular embodiments of the present disclosure will be described herein with reference to the accompanying drawings. As shown in the drawings and as described throughout the following description, and as is traditional when referring to relative positioning on an object, the terms "proximal" and "trailing" may be employed interchangeably, and should be understood as referring to the portion of a structure that is closer to a user during proper use. The terms "distal" and "leading" may also be employed interchangeably, and should be understood as referring to the portion of a structure that is farther from the user during proper use.

Figure 2:
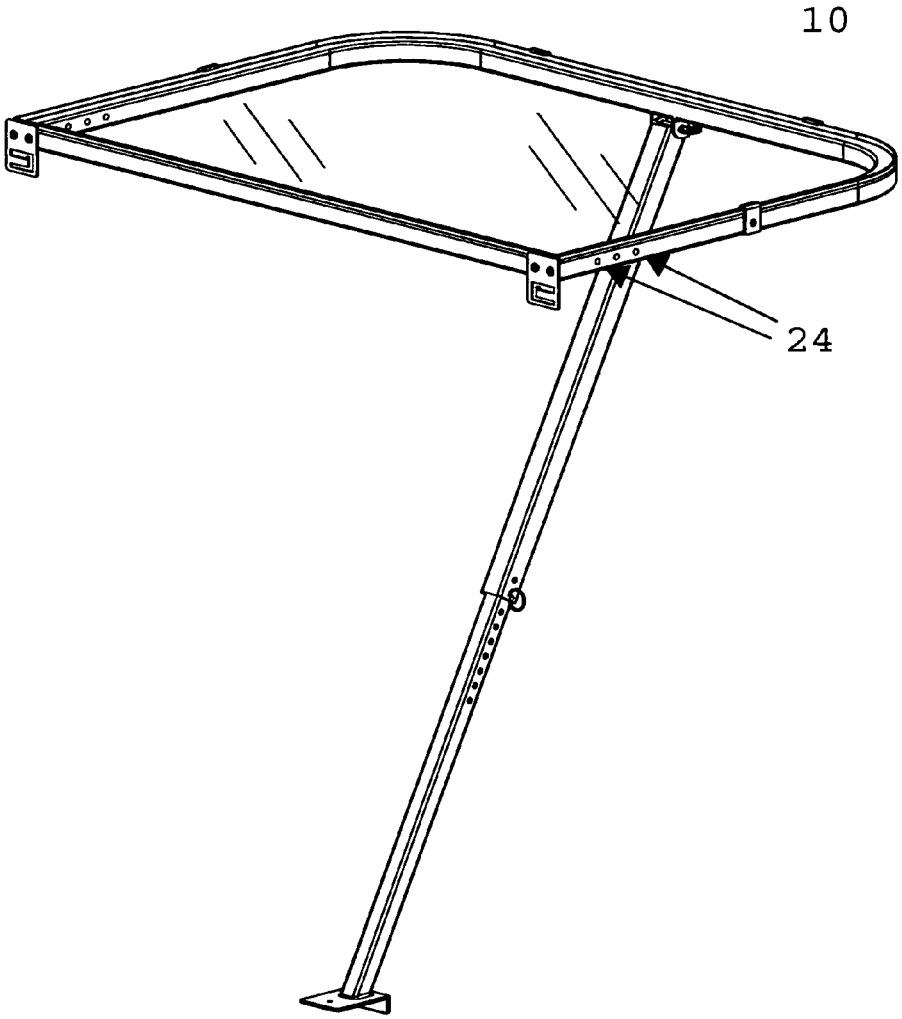
FIG. 2 is an isometric view of the Deckmate device
Figure 3:
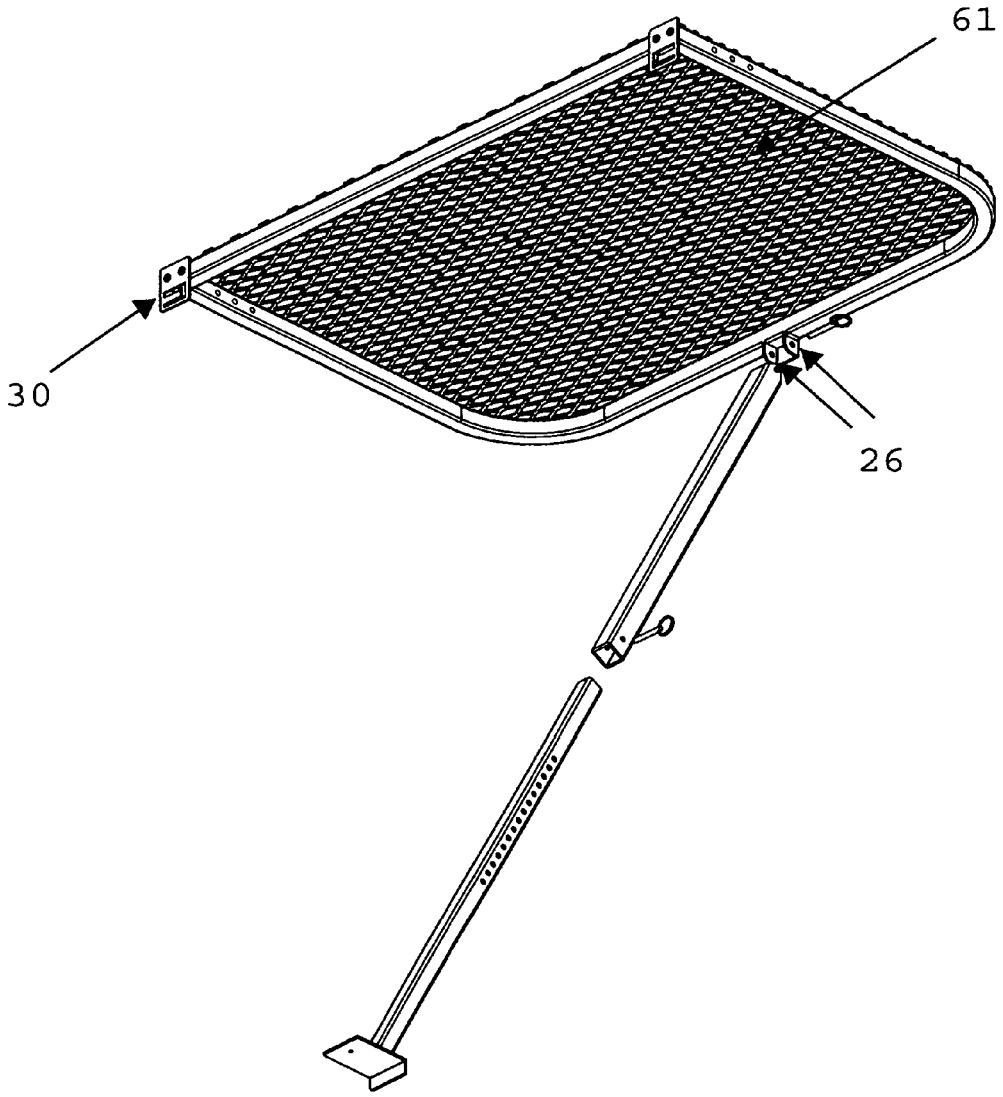
FIG. 3 is an exploded view of the telescoping leg assembly
Figure 4:
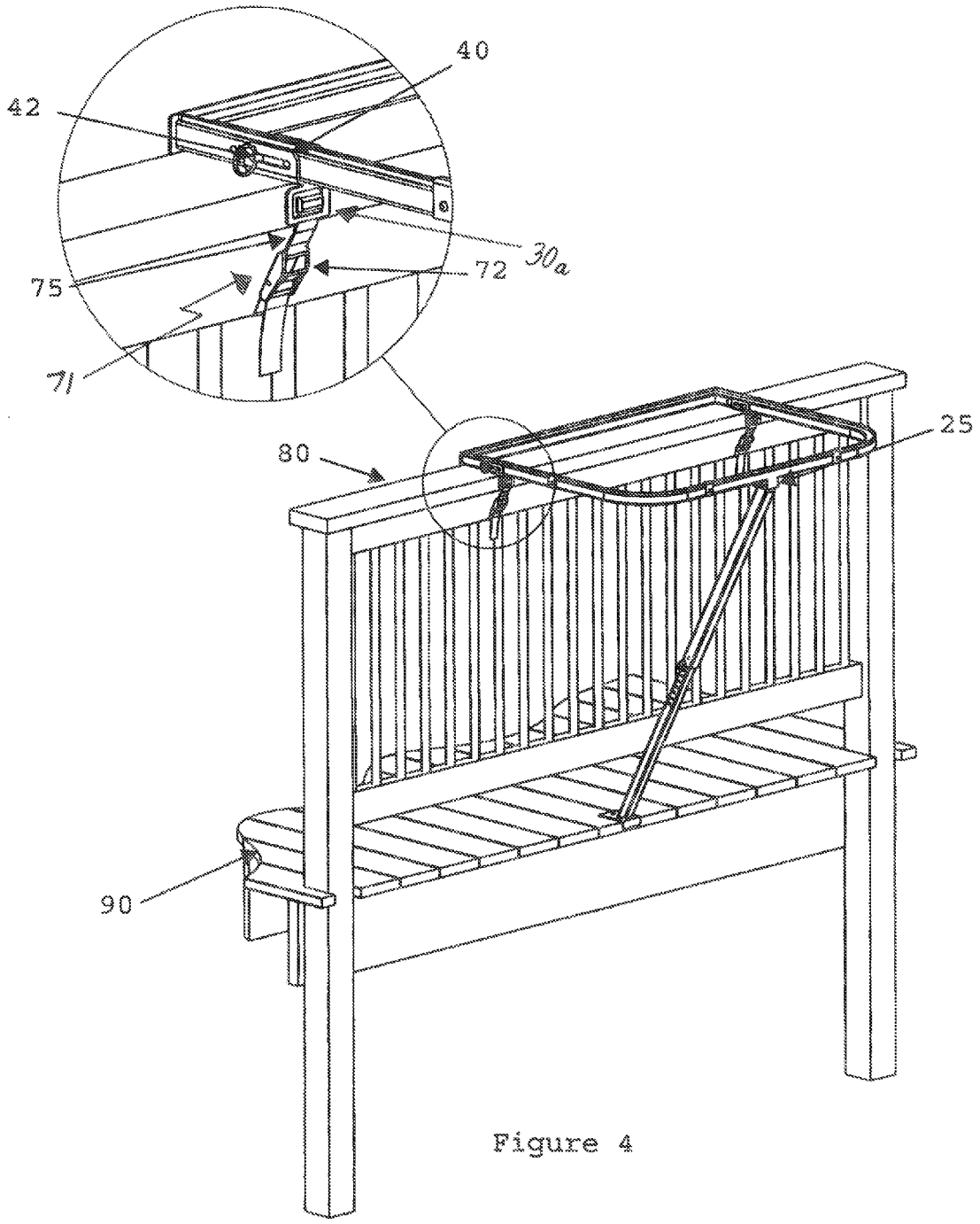
FIG. 4 is a close up view of the strap and buckle assembly

Referring initially to FIGS. 1 and 2, the rail mounting system 10 consists of a frame 20. The frame 20 can be various shapes, but is D-shaped in the preferred embodiment. In the preferred embodiment there are two first strap brackets with an L shaped feature, herein after called the L brackets 30 which are permanently mounted to the proximal portion of the frame 20 with the use of Phillips head screws, but could also be mounted with various well known techniques including but not limited to riveting and welding. Referring additionally to FIGS. 4, 5A, 5B, 12 and 13, the L brackets 30 utilize this L shaped member to contain the strapping 70 and use the vertical portion 74 of the L shape to prevent it from sliding off the L bracket 30. The strapping 70, defining a first strap member, continues and connects to a cinching type buckle 72 which connects to a second strap member, the second piece of strapping 75, that together form a first adjustable strap assembly 71. From the buckle 72 the second piece of strapping 75 connects to a second strap bracket 30*a* of a U shaped bracket 40 so that the buckle 72 can be tightened accordingly to maintain the position of the frame. Preferably, two U shaped brackets 40 are used and they are placed between the railing 80 and the frame 20, thus looping the strapping 70 and 75 around the railing 80. The U shaped bracket 40 contains a slot 46 on either side to accommodate detent pin 42 which is used to attach the U shaped bracket 40 to the frame 20. As noted in FIG. 2, the frame 20 has adjustment holes 24 to accommodate various placement locations of the U shaped bracket 40. Once the U shaped bracket 40 is in place, the strapping 70, 75 can be tightened to secure the frame 20 to the railing 80. The placement of the U shaped bracket 40 under the frame 20 and on top of the railing 80 serves a unique purpose in that it allows for the weight that is placed on the frame 20 to further secure the frame 20 in place.

The frame 20 also contains a post feature 25 on its distal side. The post feature 25 comprises two upright members 26 which have a through hole 27 for detent pin 28 to reside. The post 25 mates with a telescoping leg 50, whereby its proximal end also contains a through hole 53 to mate with detent pin 28. The telescoping leg 50 contains adjustment holes 56 along its length to accommodate various heights between railing 80 and floor 90. The adjustment holes 56 utilize detent pin 57 and through hole 54 on the upper leg portion to lock the telescoping leg 50 into place. The telescoping leg 50 also has a foot 52 which rests on the floor surface 90. The foot 52 consists of an L shape rigid member that rests on both the top and side surface of the floor 90. The foot 52 may also be screwed into place into the floor surface to prevent any movement of the telescoping leg 50. It is also contemplated that this foot 52 could be angularly adjustable to accommodate various unevenness that may occur with floor surfaces 90. The telescoping leg 50 provides additional support for the railing mounting system 10, much like a tripod would by providing a third support point. It is also contemplated that there could be more than one telescoping leg to support the frame. The legs may be all on the same side of the frame or on both the proximal and distal ends of the frame.

Lastly, the frame 20 contains securing tabs 62 that are mounted to the frame 20 by screws 63. A piece of glass 60 or metal mesh 61 is fitted to match the shape of the frame 20 is placed into the top of the frame 20 and the securing tabs 62 are placed over the glass 60 and alongside the side of the frame 20 and are screwed into place to prevent the glass 60 from moving.

The rail mounting system 10 can be utilized for supporting various items including glassware, plates, centerpieces, candles etc. The rail mounting system 10 is designed to be easily removed from the railing 80 and stored for future use. The various detent pins 28, 42 and 57 need just be removed and the telescoping leg 50 retracted, and the frame 20 with the glass 60 secured in place can be lifted off the railing 80 and the unit stored for later use.

Figure 6:
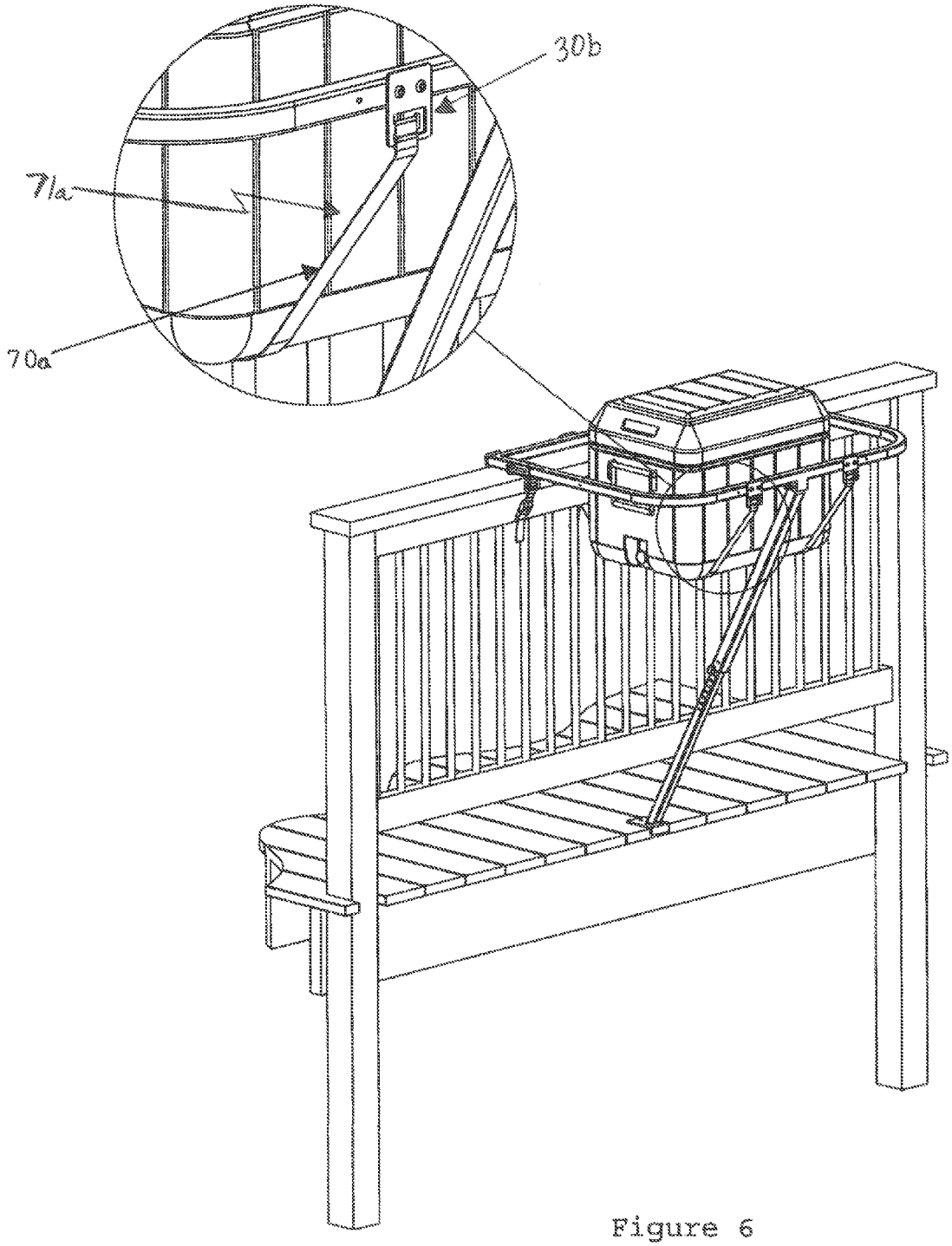
FIG. 6 is a close up view of the Deckmate in use holding a cooler
Figure 7:
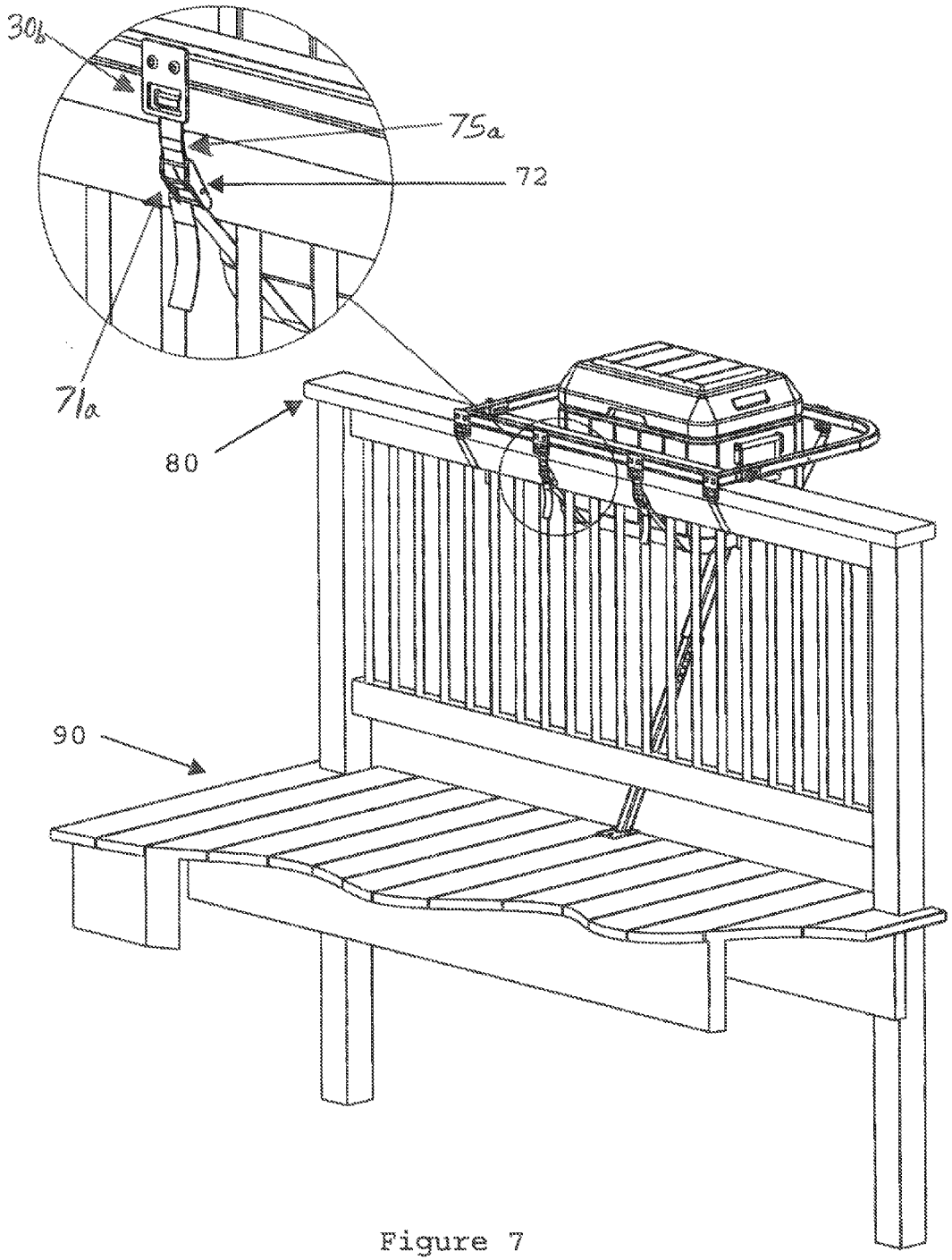
FIG. 7 is a second close up view of the Deckmate in use holding a cooler

In another embodiment, see FIGS. 6 and 7, the third strap member 70*a* and fourth strap member 75*a* of each of a pair of second adjustable strap assemblies 71*a* span from the proximal part of the frame 20 to the distal part of the frame 20 and hangs loosely between the two ends of the frame 20. The third strap member 70*a* and fourth strap member 75*a* each being coupled to a respective fixed strap bracket with an L shaped feature 30*b*. Next a cooler can be placed through the frame 20 and into contact with the third strap member 70*a* and fourth strap member 75*a* such that the bottom surface of the cooler touches the top surface of the strapping third strap member 70*a* and fourth strap member 75*a* and holds the cooler upright with the additional support of the frame 20.

In another embodiment, the frame and brackets could be formed monolithically.

Figure 8:
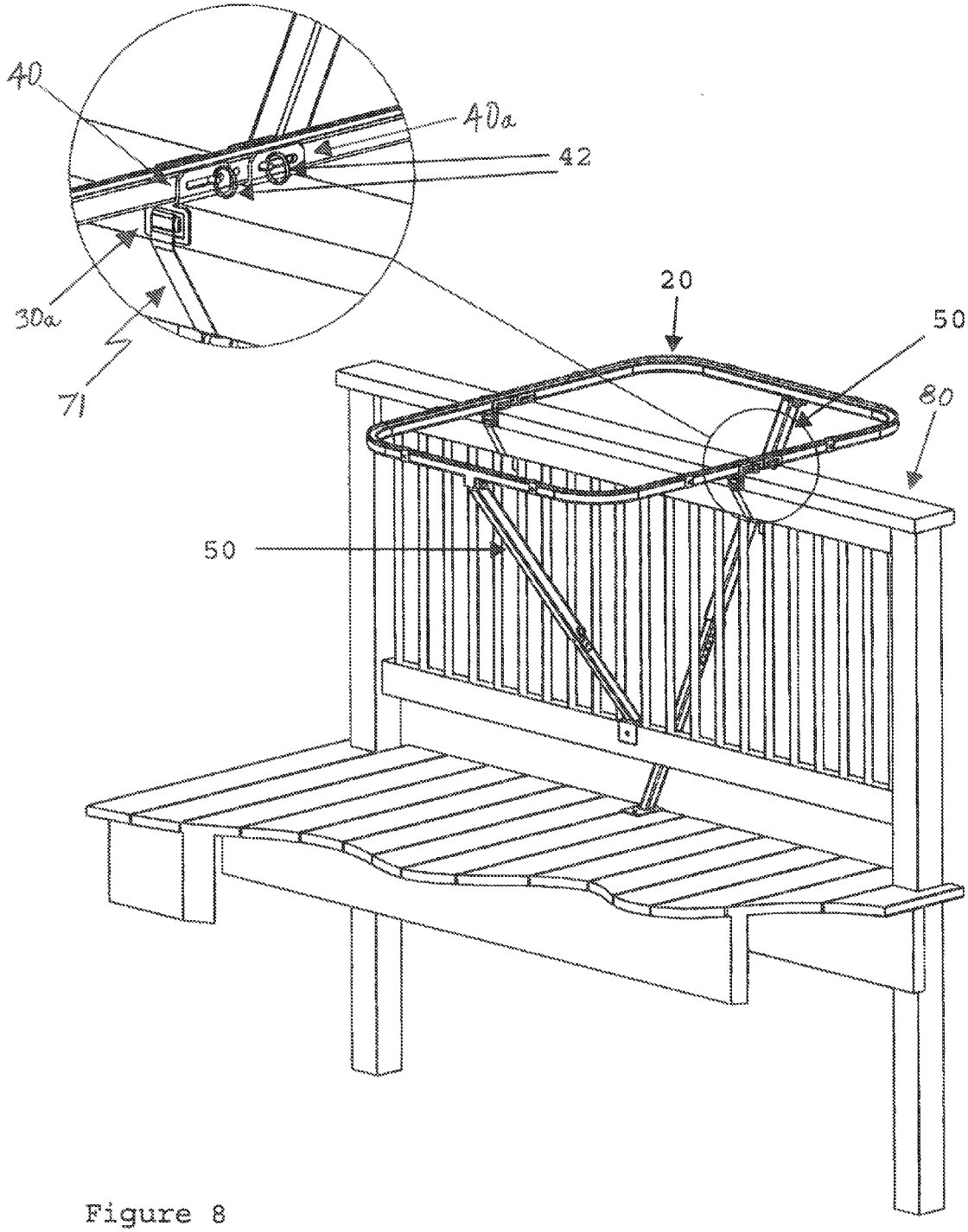
FIG. 8 is a close up view of the Deckmate spanning space inside and outside the railing
Figure 9:
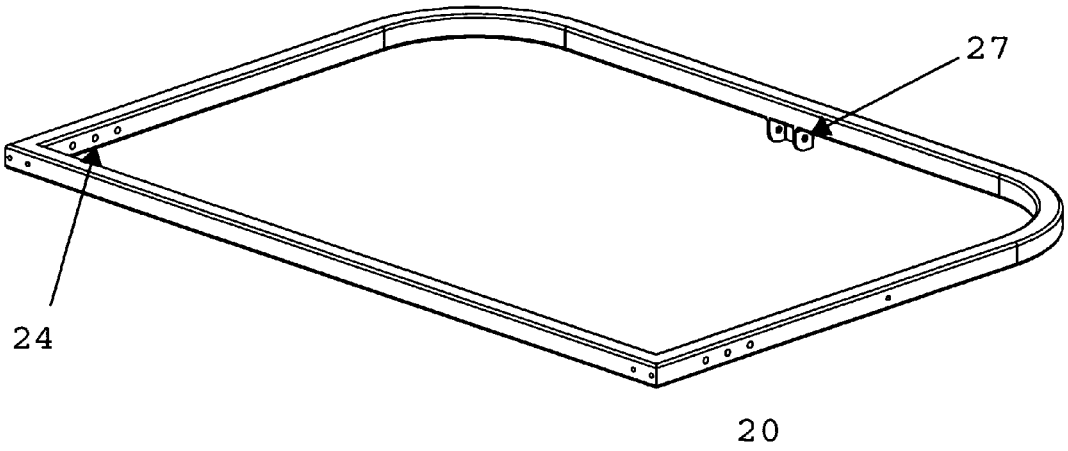
FIG. 9 is an isometric view of the frame
Figure 10:
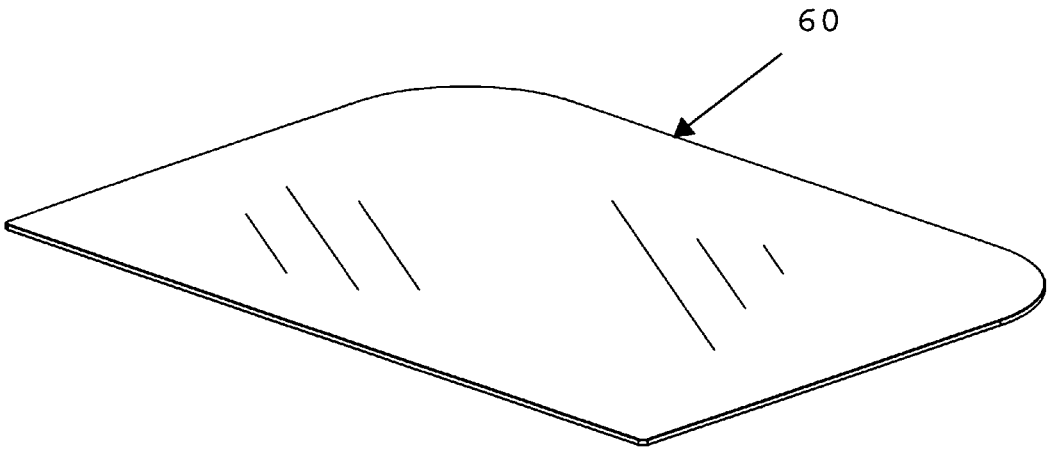
FIG. 10 is an isometric view of the glass insert for the frame
Figure 11:
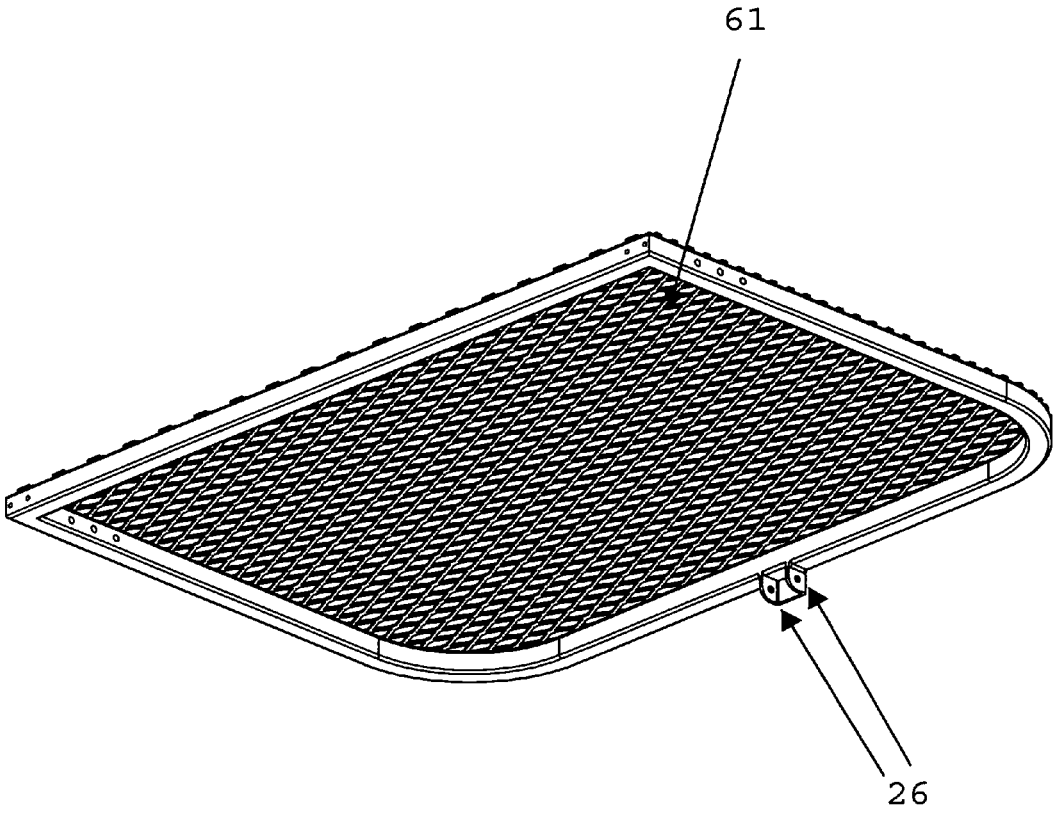
FIG. 11 is a bottom view of the frame with a mesh top insert
Figure 12:
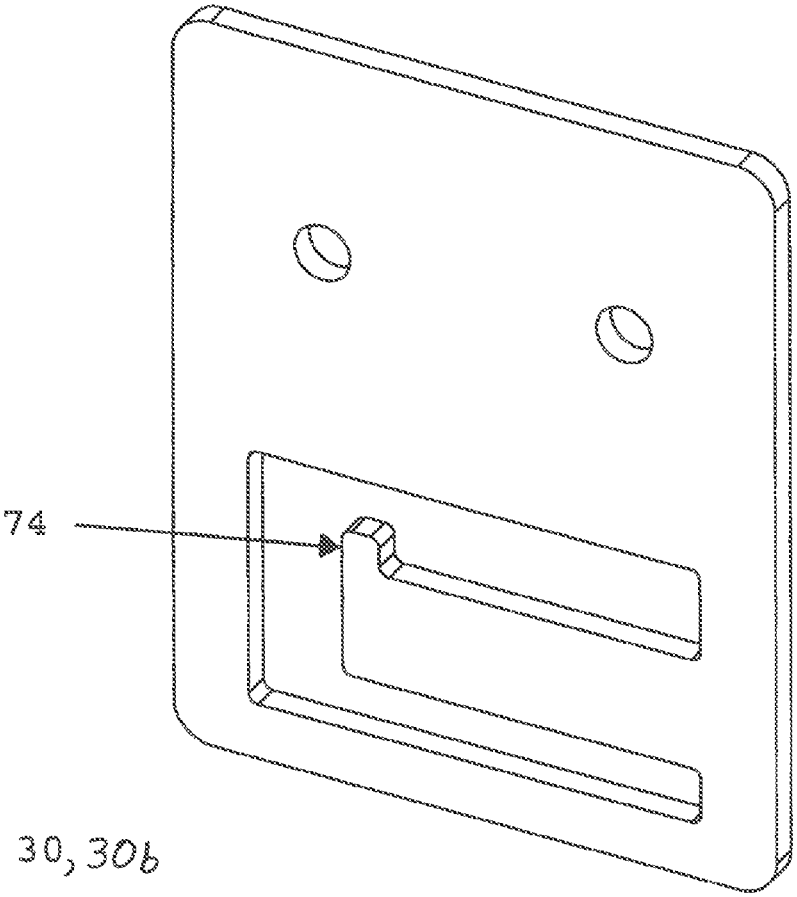
FIG. 12 is an isometric view of the L bracket
Figure 13:
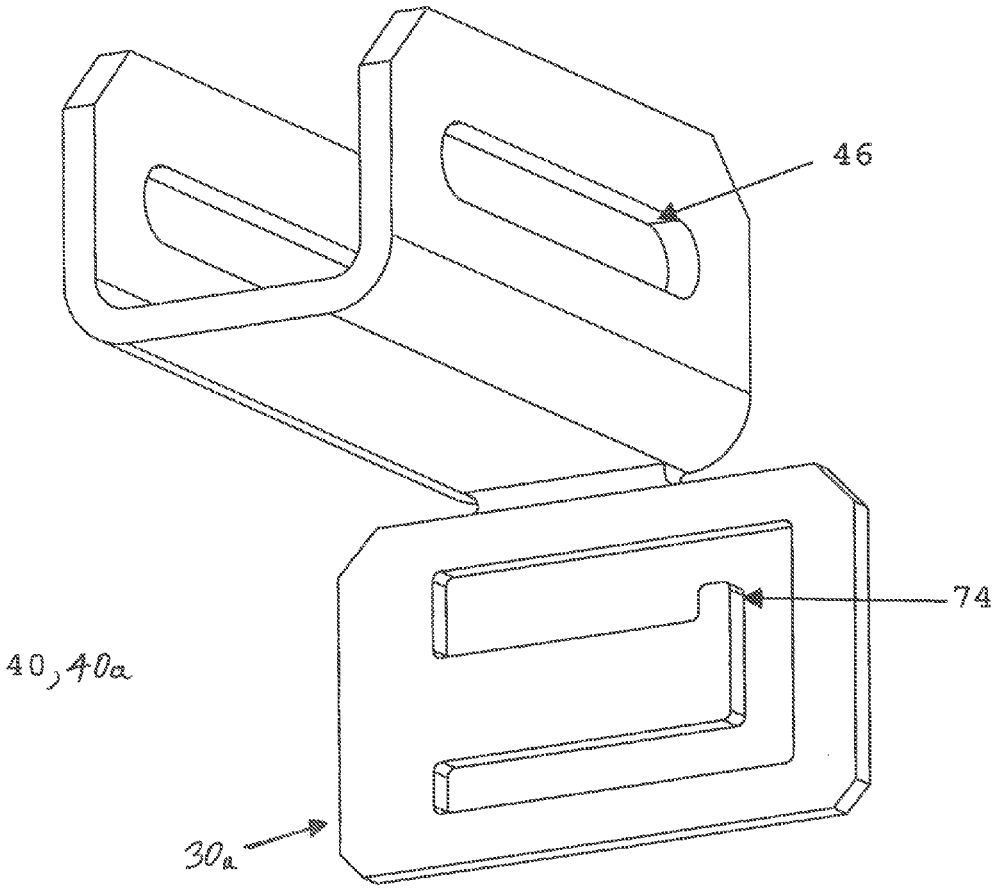
FIG. 13 is an isometric view of the U bracket
Figure 14:
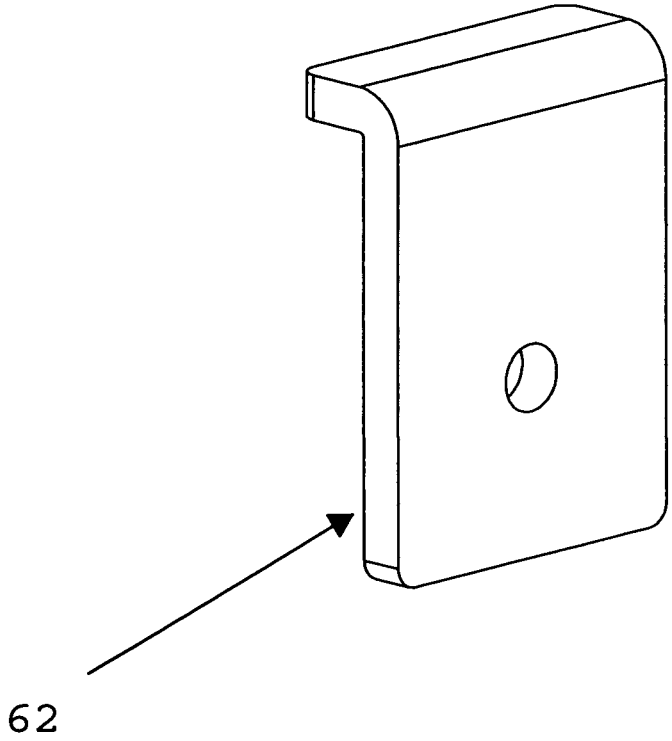
FIG. 14 is an isometric view of the tabs that support the glass insert with the frame
Figure 15:
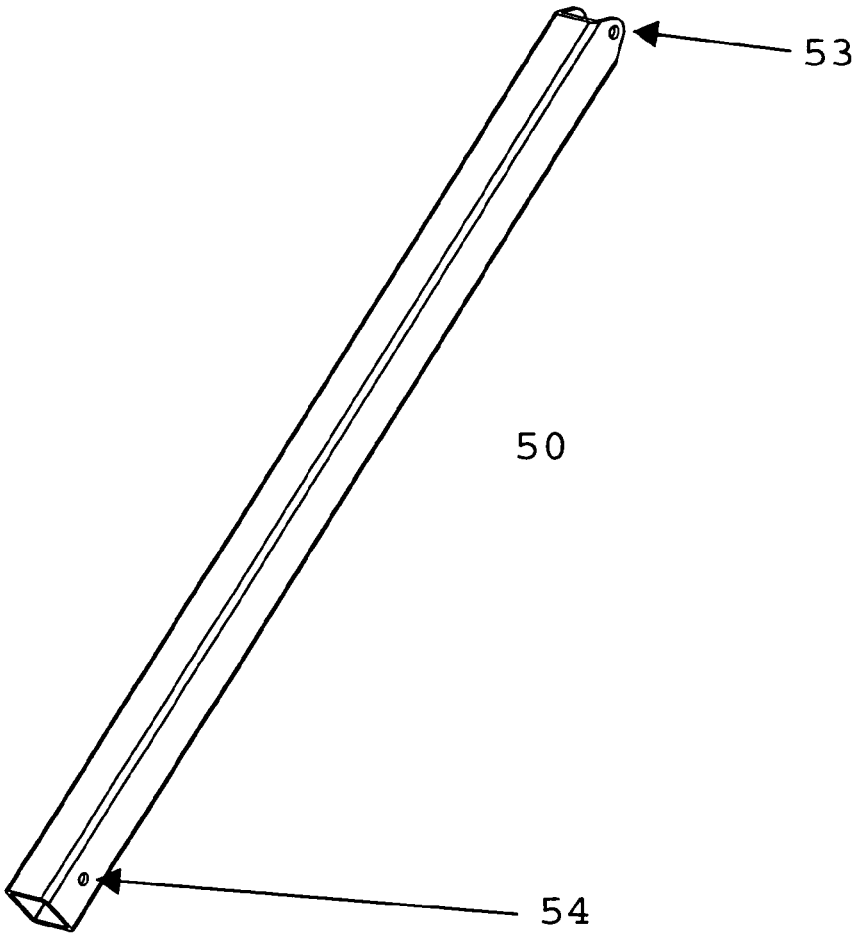
FIG. 15 is an isometric view of the top portion of the telescoping leg
Figure 16:
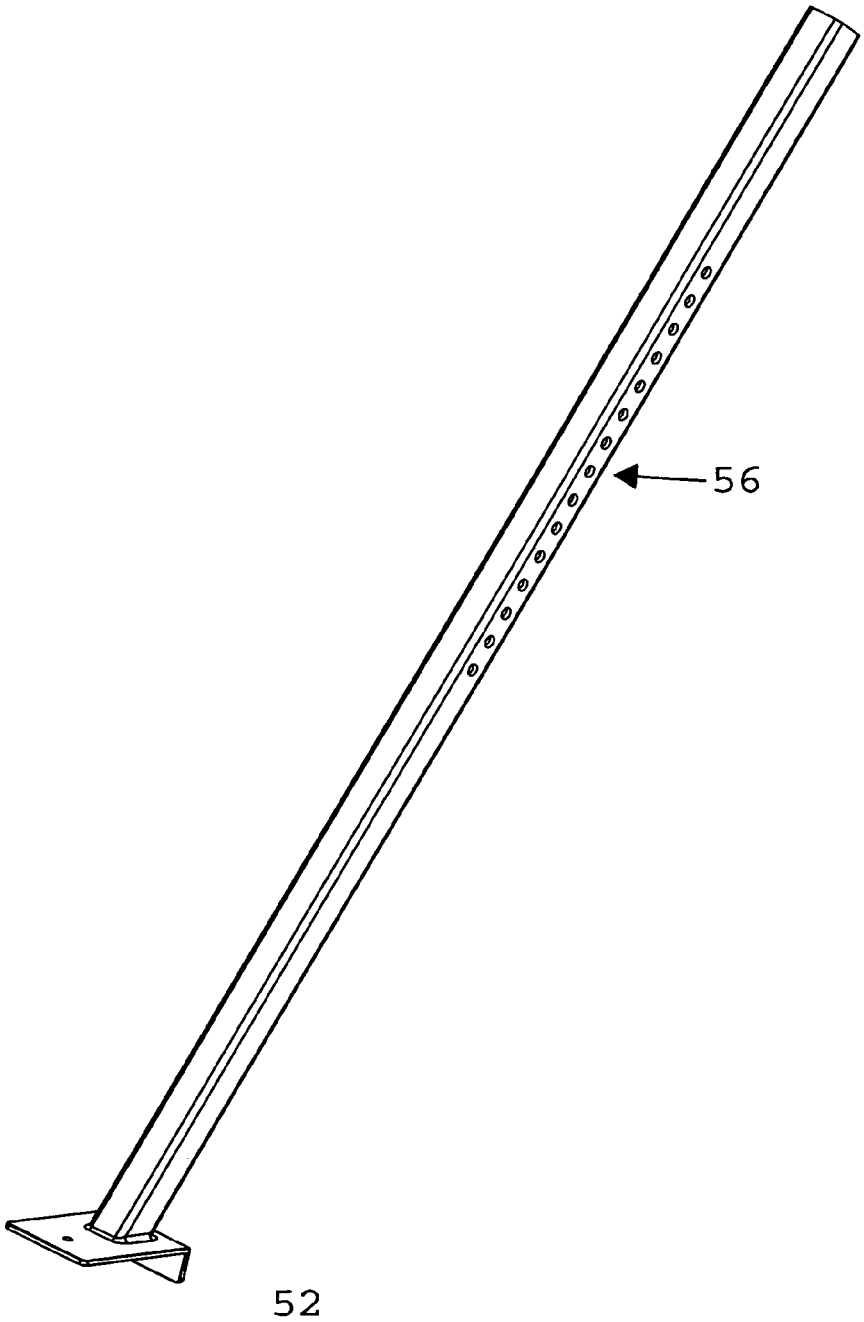
FIG. 16 is an isometric view of the bottom portion of the telescoping leg

In yet another embodiment, the frame 20 may span both inside and outside the deck, balcony or patio perimeter as noted in FIG. 8. As shown, the frame 20 is secured to the railing 80 with a pair of adjustable strap assemblies 71, each adjustable strap assembly 71 connects between a first U shaped bracket 40 and second U shaped bracket 40*a* that are each coupled to the frame 20 by respective detent pins 42 to oppose one another. This provides more surface area for containing various items including but not limited to a drop in tray that may contain recesses for holding utensils or for various herbs. This embodiment contains two telescoping arms 50 to provide support on both sides of the railing 80 since the frame 20 spans across both sides of the railing 80. The telescoping arm 50 that resides inside the railing rests on the bottom horizontal cross member of the railing, as depicted in FIGS. 5B and 8.

Figure 5A:
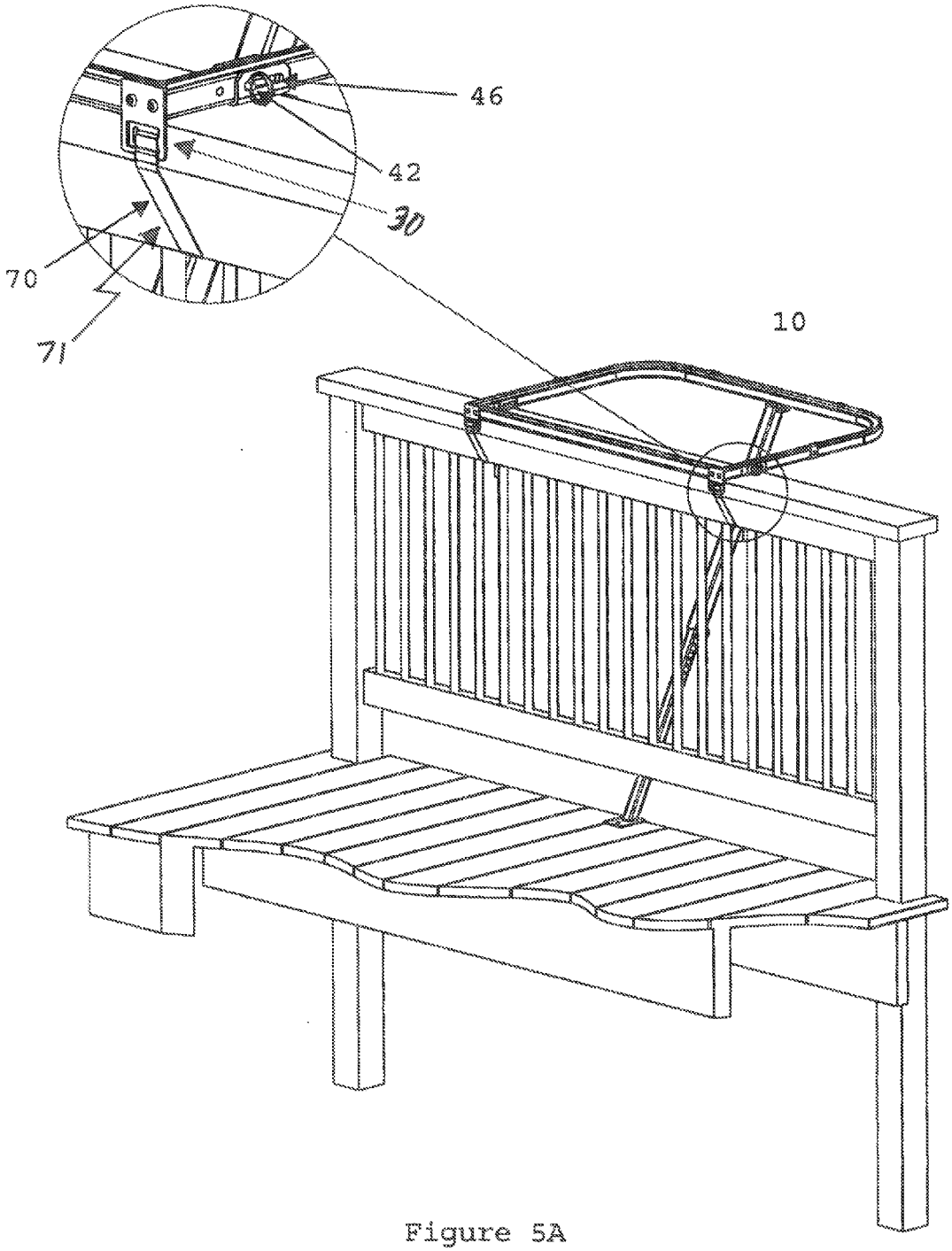
FIG. 5A is a close up view of the L bracket assembly, the Deckmate device facing outward from the railing
Figure 5B:
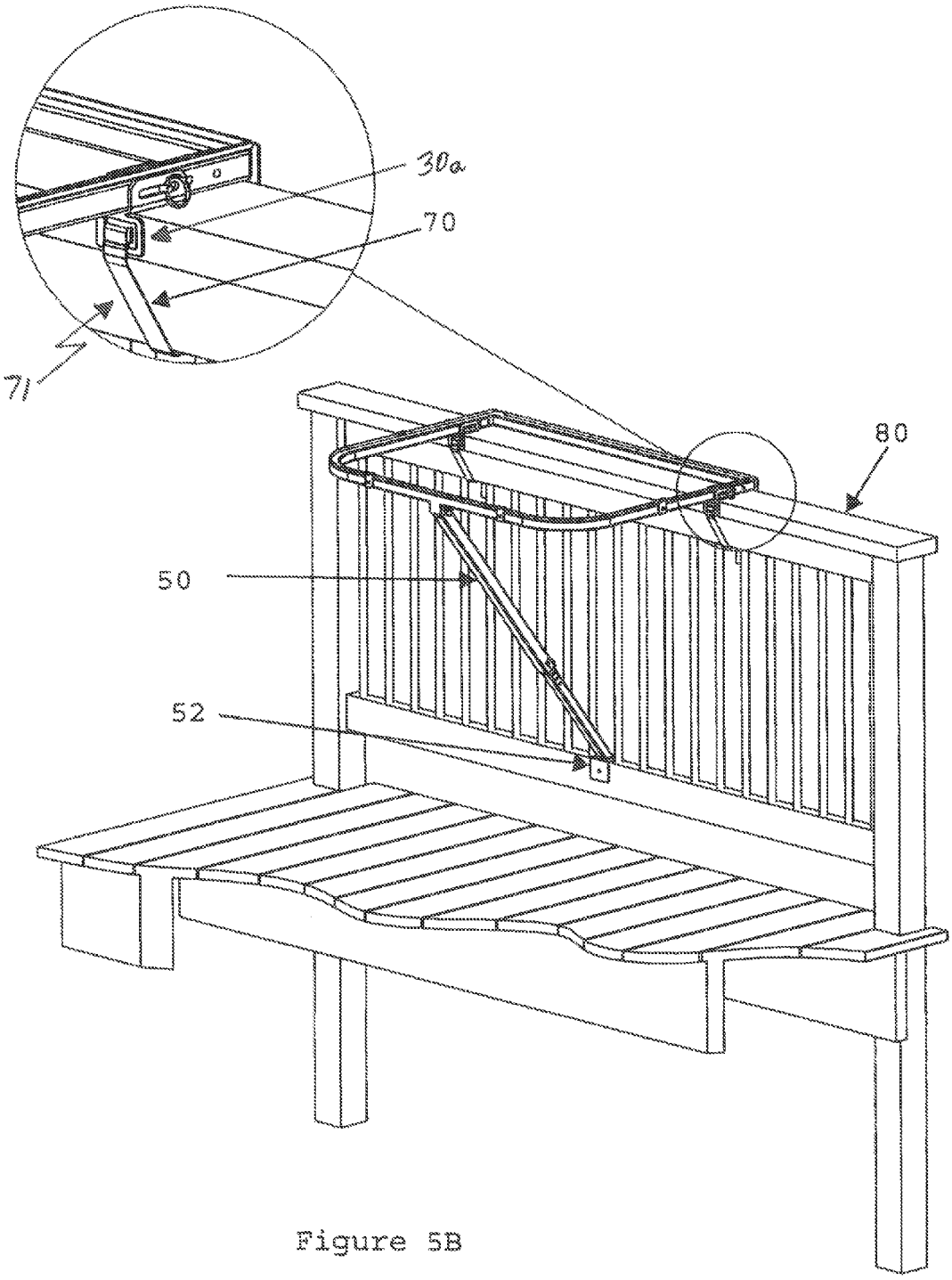
FIG. 5B is a close up view of the Deckmate device attached to the railing and facing inward from the railing

In yet another embodiment, the device may be installed such that it is extending inward from the railing as depicted in FIG. 5B, to serve as a table or countertop for instance.

What is claimed is:

1. A railing extension device, comprising:

a frame member having a closed contour;

at least a first pair of U shaped brackets secured to the frame member, each of the first pair of U shaped brackets being adjustably and releasably coupled to the frame member in a selected one of a plurality of positions;

a pair of first adjustable strap assemblies for securing the frame member to a railing structure, each of the first adjustable strap assemblies having at least one portion thereof coupled to a respective one of the first pair of U shaped brackets; and at least one telescoping leg member pivotally coupled to the frame and extending therefrom to a supporting surface.

2. The railing extension device of claim 1, where each of the pair of first adjustable strap assemblies includes a first strap member having one end thereof coupled to the frame, a second strap member having one end thereof coupled to a corresponding one of the first pair of U shaped brackets, and a first fastening device for releasably securing another end of the first strap member to another end of the second strap member.

3. The railing extension device of claim 1, where at least a portion of the frame overlays the railing structure and each of the first pair of U shaped brackets is located with a portion thereof disposed between the railing structure and the frame and thereby weight on the railing extension device further secures the first pair of U shaped brackets in position.

4. The railing extension device of claim 2, where the frame includes at least a pair of first strap brackets affixed thereto, the one end of the first strap member of each of the pair of first adjustable strap assemblies is connected to a corresponding one of the first strap brackets.

5. A method for securing a railing extension device to a railing, comprising the steps of:

providing a frame member having a pair of U shaped brackets where each is adjustably and releasably coupled to the frame member in a selected one of a plurality of positions, and at least a pair of adjustable strap assemblies having an end portion thereof coupled to a respective one of the first pair of U shaped brackets and an opposing end portion coupled to the frame;

positioning the frame to extend horizontally across an upper portion of the railing;

adjusting a position of each of the pair of U shaped brackets to overlay the upper portion of the railing;

extending each of the pair of adjustable strap assemblies around the upper portion of the railing to capture the upper portion of the railing between each of the pair of U shaped brackets and a corresponding adjustable strap assembly;

securing the frame member to the railing by tightening each of the pair of strap assemblies; and extending at least one telescoping leg member to extend from the frame to a supporting surface.

6. The railing extension device of claim 4, where each of the first strap brackets includes an L shaped tab having (a) a longitudinally extended portion for receiving a portion of the one end of a corresponding one of the first strap members thereon, and (b) a portion disposed at a distal end of the longitudinally extended portion extending transverse thereto for retaining the one end of the first strap member on the L shaped tab.

7. The railing extension device of claim 4, where each of the first pair of U shaped brackets includes a second strap bracket extending therefrom, the second strap bracket including an L shaped tab having (a) a longitudinally extended portion for receiving a portion of the one end of a corresponding one of the second strap members thereon, and (b) a portion disposed at a distal end of the longitudinally extended portion extending transverse thereto for retaining the one end of the second strap member on the L shaped tab.

8. The railing extension device of claim 1, further comprising a second pair of U shaped brackets secured to the frame member, each of the second pair of U shaped brackets being adjustably and releasably coupled to the frame member in a selected one of a plurality of positions, each of the first adjustable strap assemblies being coupled between corresponding ones of the first and second pairs of U shaped brackets.

9. The railing extension device of claim 8, where each of the pair of first adjustable strap assemblies includes a first strap member having one end thereof coupled to a respective one of the U shaped brackets of one of the pairs of the first and second pairs of U shaped brackets, a second strap member having one end thereof coupled to a corresponding one of the U shaped brackets of the other of the pairs of the second and first pairs of U shaped brackets, and a first fastening device for releasably securing another end of the first strap member to another end of the second strap member.

10. The railing extension device of claim 9, where each of the first and second pairs of U shaped brackets includes a strap bracket extending therefrom, the strap bracket including an L shaped tab having (a) a longitudinally extended portion for receiving a portion of the one end of a corresponding one of the first and second strap members thereon, and (b) a portion disposed at a distal end of the longitudinally extended portion extending transverse thereto for retaining the one end of the corresponding one of the first and second strap members on the L shaped tab.

11. The railing extension device of claim 1, where a pair of telescoping leg members are each pivotally coupled to the frame and extend therefrom to a supporting surface, a first of the pair of telescoping leg members being pivotally coupled to one side of the frame and a second of the pair of telescoping leg members being pivotally coupled to an opposing side of the frame.

12. The railing extension device of claim 1, further comprising:

a panel member overlaying the frame; and a plurality of securing tab members secured to the frame and clampingly engaging the panel member.

13. The railing extension device of claim 12, where the panel member is formed of one of a transparent or mesh material.

14. The railing extension device of claim 12, where each of the securing tab members have an inverted L shaped contour.

15. The railing extension device of claim 10, further comprising:

at least a pair of fixed strap brackets respectively coupled to opposing sides of the frame;

at least a second adjustable strap assembly coupled between the pair of fixed strap brackets for supporting an article thereon to be accessible through an open area circumscribed by the frame.

16. The railing extension device of claim 15, where the second adjustable strap assembly includes a third strap member having one end thereof coupled to a respective one of the pair of fixed strap brackets, a fourth strap member having one end thereof coupled to the other of the pair of fixed strap brackets, and a second fastening device for releasably securing another end of the third strap member to another end of the fourth strap member.

17. The railing extension device of claim 16, where each of the fixed strap brackets includes an L shaped tab having (a) a longitudinally extended portion for receiving a portion of the one end of a corresponding one of the third and fourth strap members thereon, and (b) a portion disposed at a distal end of the longitudinally extended portion extending transverse thereto for retaining the one end of the corresponding one of the third and fourth strap members on the L shaped tab.

18. The railing extension device of claim 15, where a plurality of pairs of fixed strap brackets are coupled to the frame and a corresponding number of second adjustable strap assemblies extend between a corresponding pair of fixed strap brackets to span between opposing sides of the frame for supporting an article thereon to be accessible through an open area circumscribed by the frame.

19. The method of claim 5, where the step of providing a frame member includes the step of providing at least a pair of strap brackets coupled to the frame, each strap bracket having an L shaped tab for retaining the opposing end portion of a corresponding one of the pair of adjustable strap assemblies thereon.

20. The method of claim 5, further comprising the step of securing a panel member to the frame member.

21. The method of claim 20, where the step of securing a panel member includes the steps of overlaying the panel member on the frame and using a plurality of securing tab members to clampingly couple the panel member to the frame.

22. A method for securing a railing extension device to a railing, comprising the steps of:

providing a frame member having a first pair of U shaped brackets and a second pair of U shaped brackets where each U shaped bracket is adjustably and releasably coupled to the frame member in a selected one of a plurality of positions, and at least a pair of adjustable strap assemblies each having an end portion thereof coupled to a respective one the U shaped brackets of the first pair of U shaped brackets and an opposing end portion coupled to a corresponding one of the U shaped brackets of the second pair of U shaped brackets;

positioning the frame to extend horizontally across an upper portion of the railing;

adjusting a position of each of the U shaped brackets of the first and second pairs of U shaped brackets to overlay the upper portion of the railing;

extending each of the pair of adjustable strap assemblies around the upper portion of the railing to capture the upper portion of the railing between the U shaped brackets of the first and second pairs of U shaped brackets and a corresponding one of the adjustable strap assemblies;

securing the frame member to the railing by tightening a respective buckle of each of the pair of strap assemblies; and extending at least one telescoping leg member to extend from the frame to a supporting surface.

23. The method of claim 22, further comprising the step of securing a panel member to the frame member.

24. The method of claim 23, where the step of securing a panel member includes the steps of overlaying the panel member on the frame and using a plurality of securing tab members to clampingly couple the panel member to the frame.

25. A railing extension device, comprising:

a frame member having a closed contour with at least a portion thereof being disposed in overlaying relationship with an upper portion of a railing structure;

at least a first pair of U shaped brackets secured to the frame member, each of the first pair of U shaped brackets having a portion thereof disposed between the upper portion of the railing structure and the frame so that weight on the railing extension device further secures the first pair of U shaped brackets in position;

at least a pair of adjustable strap assemblies for securing the frame member to the upper portion of the railing structure, each of the adjustable strap assemblies extending around a lower portion of the upper portion of the railing structure and having at least one portion thereof coupled to a respective one of the first pair of U shaped brackets; and at least one telescoping leg member pivotally coupled to the frame and extending therefrom to a supporting surface.

26. The railing extension device of claim 25, where each of the first pair of U shaped brackets is adjustably and releasably coupled to the frame member in a selected one of a plurality of positions.

27. The railing extension device of claim 25, where the frame includes at least a pair of first strap brackets affixed thereto, a first end portion of each of the pair of adjustable strap assemblies being connected to a corresponding one of the strap brackets.

28. The railing extension device of claim 26, where each of the first pair of U shaped brackets has a second strap bracket extending therefrom, a second end portion of each of the pair of adjustable strap assemblies being connected to a corresponding one of the second strap brackets.

29. The railing extension device of claim 25, further comprising a second pair of U shaped brackets secured to the frame member, each of the adjustable strap assemblies being coupled between corresponding ones of the first and second pairs of U shaped brackets.

30. The railing extension device of claim 29, where each of the second pair of U shaped brackets has a portion thereof disposed between the upper portion of the railing structure and the frame.

31. The railing extension device of claim 29, where each of the second pair of U shaped brackets is adjustably and releasably coupled to the frame member in a selected one of a plurality of positions.

32. The railing extension device of claim 29, where each of the first and second pair of U shaped brackets has a strap bracket extending therefrom, each of the pair of adjustable strap assemblies being connected between the strap brackets of corresponding ones of the first and second pairs of U shaped brackets.

* * * * *